United States Patent [19]

Nakamura et al.

[11] Patent Number: 4,743,909

[45] Date of Patent: May 10, 1988

[54] METHOD AND APPARATUS FOR SETTING DIRECTION OF A PARABOLIC ANTENNA RELATIVE TO A COMMUNICATING SATELLITE

[76] Inventors: Akihiro Nakamura; Takeo Horiuchi; Makoto Maruyama; Toshiaki Inoue, all c/o Nagano Nihon Musen Kabushiki Kaisha, 1463 Nishi-Tsuruga-machi, Oaza-Tsuruga, Nagano-shi, Nagano-ken, Japan

[21] Appl. No.: 96,226

[22] Filed: Sep. 4, 1987

Related U.S. Application Data

[63] Continuation of Ser. No. 634,994, Jul. 27, 1984.

[30] Foreign Application Priority Data

Mar. 17, 1984 [JP] Japan ..... 59-51744

[51] Int. Cl.[4] ..... H01Q 3/00

[52] U.S. Cl. ..... 342/359; 342/356

[58] Field of Search ..... 342/359, 357, 356, 352

[56] References Cited

U.S. PATENT DOCUMENTS 4,047,175 9/1977 Taira et al. ..... 342/359

4,352,202 9/1982 Carney ..... 342/359

*Primary Examiner*—Theodore M. Blum

*Attorney, Agent, or Firm*—Michael N. Meller

[57] ABSTRACT

A method of and apparatus for setting the direction of a parabolic antenna towards a broadcasting satellite, suitable for use in the case where a plurality of satellites are available for service. The elevation angle and the azimuth angle of the antenna with respect to each satellite are minutely adjusted while the state of receiving of waves from the satellite is watched, and the values of the elevation and azimuth angles for each satellite are stored in a memory section when the optimum state of receiving is attained. When the user selects one of the satellites through a selecting section, a control section operates to activate a driving section to swing the antenna vertically and horizontally in accordance with the stored optimum data, thus directing the antenna correctly towards the designated satellite.

5 Claims, 1 Drawing Sheet

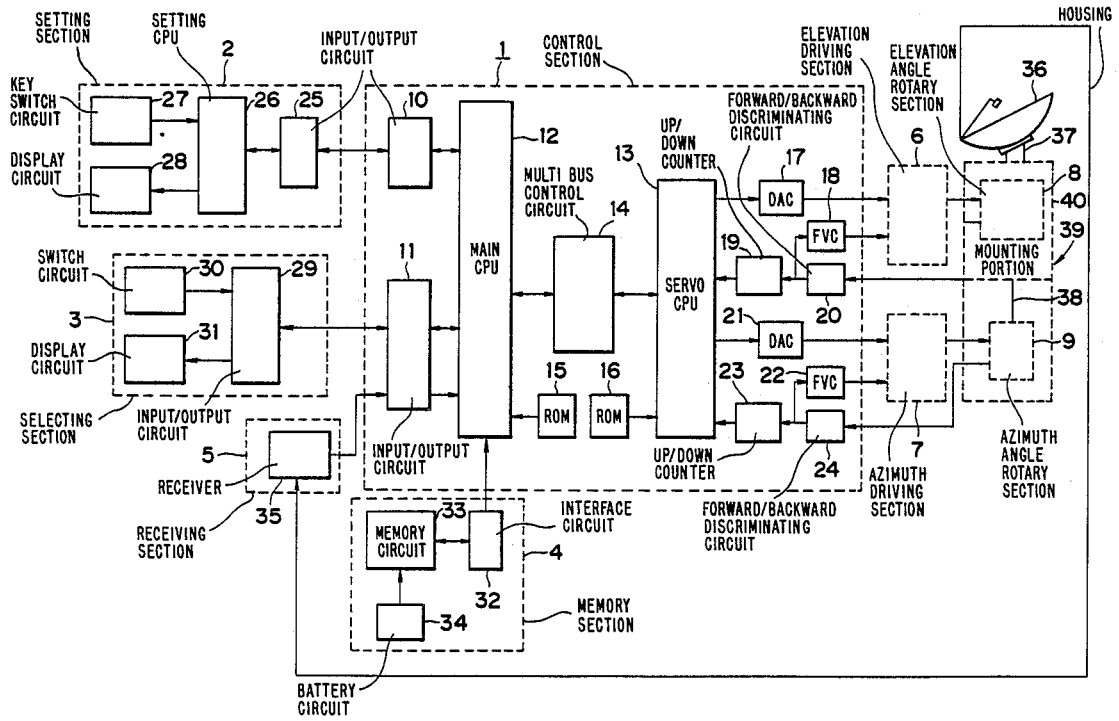

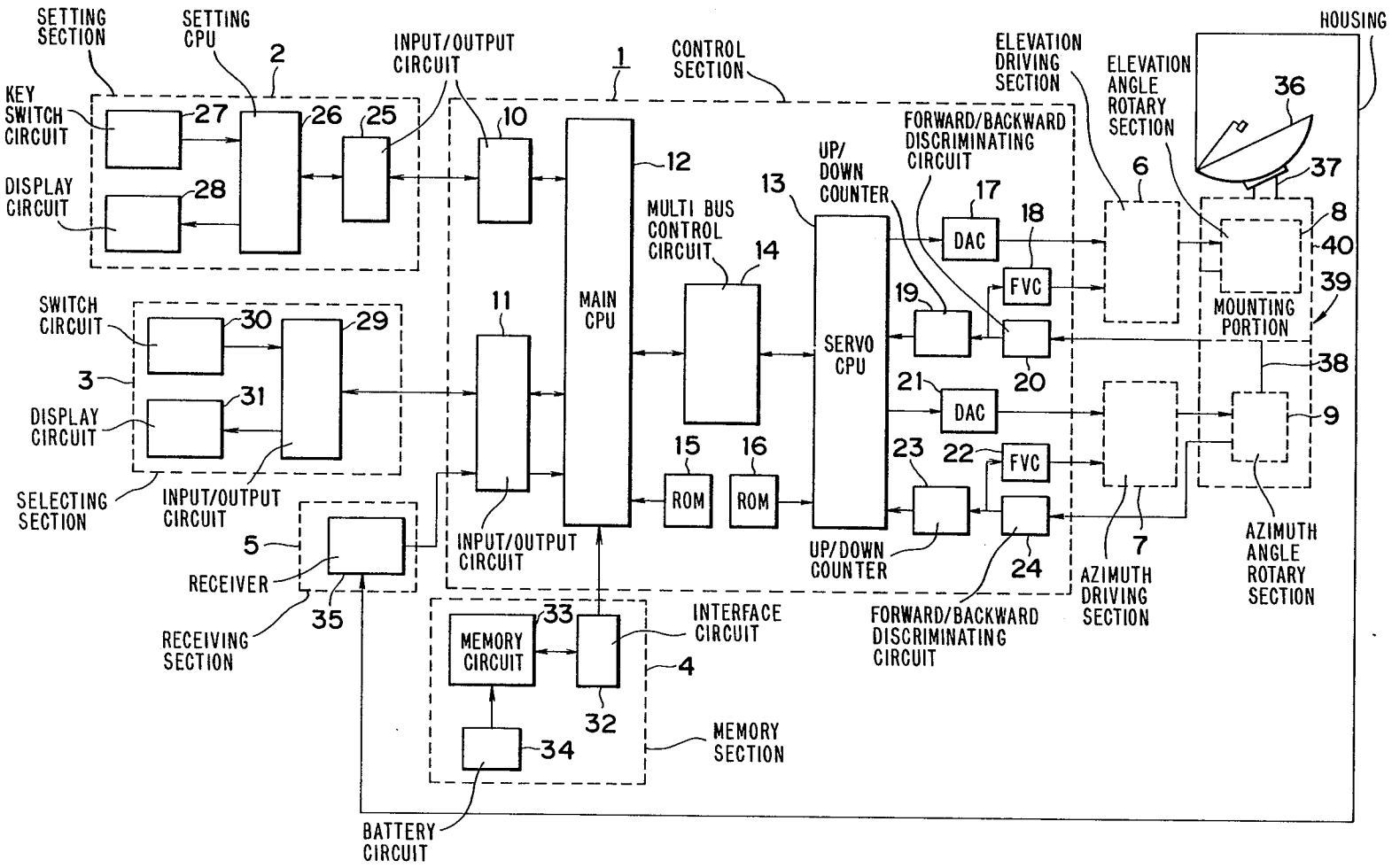
HOUSING
36
37
8
40
39
38
9
MOUNTING PORTION
AZIMUTH ANGLE ROTARY SECTION
ELEVATION ANGLE ROTARY SECTION
6
7
AZIMUTH DRIVING SECTION
ELEVATION DRIVING SECTION
FORWARD/BACKWARD DISCRIMINATING CIRCUIT
18
FVC
20
FVC
24
17
DAC
DAC
22
19
21
23
FORWARD/BACKWARD DISCRIMINATING CIRCUIT
UP/DOWN COUNTER
SERVO CPU
UP/DOWN COUNTER
13
14
16
ROM
CONTROL SECTION
MULTI BUS CONTROL CIRCUIT
15
ROM
INTERFACE CIRCUIT
MEMORY SECTION
4
12
1
MAIN CPU
32
33
34
10
11
INPUT/OUTPUT CIRCUIT
MEMORY CIRCUIT
INPUT/OUTPUT CIRCUIT
BATTERY CIRCUIT
25
29
35
26
2
30
31
5
SETTING CPU
27
28
INPUT/OUTPUT CIRCUIT
RECEIVER
RECEIVING SECTION
SETTING SECTION
KEY SWITCH CIRCUIT
DISPLAY CIRCUIT
SWITCH CIRCUIT
3
DISPLAY CIRCUIT
SELECTING SECTION

METHOD AND APPARATUS FOR SETTING DIRECTION OF A PARABOLIC ANTENNA RELATIVE TO A COMMUNICATING SATELLITE

This application is a continuation, of application Ser. No. 634,994, filed 7/27/84.

BACKGROUND OF THE INVENTION

1. Field of the Invention

The present invention relates to a method of and apparatus for setting the direction of a parabolic antenna relative to a communicating satellite. More particularly, the invention is concerned with a method of and apparatus for setting the direction of a parabolic antenna relative to a broadcasting satellite, when a TV carrier wave transmitted by a communicating satellite is received by a household IV receiver.

2. Description of the Prior Art

In general, an antenna device is required to stand up against all weather conditions, such as strong wind, while bearing the weight of the antenna itself. In addition, the antenna device has to incorporate the functions of directing the antenna toward the satellite.

When the antenna is to be directed towards simply one satellite, it suffices only to fix the antenna to aim at the satellite, because the communicating satellite is usually stationary. In the case where a plurality of broadcasting satellites are available, however, it is necessary to change the direction of the antenna to aim at the selected satellite each time a selection is made. Conventionally, the changing of direction of an antenna aiming at a desired satellite, as well as the fixing of the antenna, has been made on a wholly manual basis. Thus, where there are a plurality of broadcasting satellites available, the user is obliged to leave the house to change the antenna direction each time the satellite aimed at is changed. In fact, this work is quite troublesome, particularly in a severe winter or under bad weather conditions. In addition, the user often fails to catch the desired wave, when he wishes to receive the wave from a new satellite, due to delay occasioned by the work of directing the antenna towards the new satellite.

SUMMARY OF THE INVENTION

Object of the Invention

Accordingly, an object of the invention is to provide a parabolic antenna apparatus for receiving a TV carrier wave from a broadcasting satellite, which permits the user to swiftly direct the antenna toward the desired satellite without leaving the house, thereby obviating the above-described problems of the prior art.

Brief Summary of the Invention

To this end, according to one aspect of the invention, there is provided a method of setting the direction of a parabolic antenna towards at least one broadcasting satellite, comprising: adjusting the azimuth angle and the elevation angle of the parabolic antenna with respect to the satellite, while watching the state of receiving of waves from the satellite; recording the values of the elevation angle and the azimuth angle when the state of receiving of the waves is optimized; and directing the antenna towards the satellite by controlling the elevation angle and the azimuth angle of the antenna in conformity with the stored values of the elevation angle and azimuth angle.

According to another aspect of the invention, there is provided an apparatus for setting the direction of a parabolic antenna with respect to a broadcasting satellite comprising: a control section connected to a driving section of the antenna having an elevation driving section and an azimuth driving section; a memory section connected to the control section; a setting section connected to the control section through an input/output circuit; a selecting section connected to the control section through the input/output circuit; and a receiving section connected to the control section through the input/output section.

According to the invention, the parabolic antenna for receiving waves from satellites has two independent axes of rotation: namely, an axis about which the antenna rocks to change its azimuth angle, and an axis about which the antenna is swung to change its elevation angle. Thus, the azimuth and the elevation are represented by angles drawn from respective reference or zero points.

Any type of receiving observation means capable of watching or observing the received input can be used. A practical example of such a means is the CRT of the TV receiver. It is also possible to observe the received input by measuring the electric current flowing through a tuning circuit.

In the apparatus of the invention, the control section has a function of computing the elevation angle and azimuth angle of the satellite to be aimed at by the antenna, upon input of the latitude and longitude of the point at which the antenna is situated, as well as a function of controlling the operation of various sections such as a memory section having a recording portion, setting section, selecting section, elevation driving section and an azimuth driving section. Any type of controller is usable provided that these requirements are met.

The memory section has a memory which stores various data such as various constants necessary for the operation of the apparatus, elevation angles and azimuth angles of various satellites, and so forth. Such data is read out and delivered as desired to the control section. Preferably, the memory is of such a type that the information stored in the memory is never erased even when the electric power supply to the apparatus is terminated, although any type of memory capable of performing the aforementioned functions is usable.

Examples of the constants to be stored in the memory section are: radius of the earth, altitudes of the communicating satellites, and maximum values of the elevation angles and azimuth angles of various satellites.

The setting section is adapted to input to the control section various information signals necessary for the operation of the elevation angle driving section and the azimuth angle control section, thereby to direct the parabolic antenna towards the desired satellite. When the state of receiving the carrier wave from the broadcasting satellite is optimized, the setting section gives instructions to the control section to store in the memory section the instant elevation angle and the azimuth angle taken by the parabolic antenna, while renewing the constants stored in the memory section. The setting section is provided with a display unit which permits the user to confirm the information and contents, which are necessary for directing the parabolic antenna towards the communicating satellite.

Referring now to the selecting section, this section is adapted to give to the control section information as to which one of the communicating satellites is to be selected. An example of the selecting section has switches corresponding to respective communicating satellites, by means of which the user can appoint and select the desired satellite. Needless to say, however, other selecting means equivalent in function to the switches can be used.

Upon receipt of the signals from the selecting section, the control section reads the information concerning the elevation angle and azimuth angle of the desired satellite out of the memory section. It executes a computation to produce signals which are delivered to the elevation driving unit and the azimuth driving unit to make them swing the antenna about the azimuth axis and elevation axis until the antenna comes to a position where it is correctly aimed at the desired satellite. In order to permit the user to confirm the presence of the instruction given by the selecting section, the selecting section is preferably provided with a display unit, which indicates that the control section is being instructed by the selecting section.

In the apparatus of the invention, the elevation driving section and the azimuth driving section receive, respectively, an elevation angle setting signal and an azimuth angle setting signal, and amplify these signals to levels large enough to activate the elevation and azimuth driving units until the antenna comes to a position where it is aimed at the desired satellite.

When the parabolic antenna has been swung to aim at the desired satellite through the operation of the azimuth and elevation driving units, the receiving section delivers a signal representing the fact that the antenna has been directed correctly. This signal is inputted to the control section which in turn, produces a signal for stopping the operation of the elevation and azimuth driving units thereby fixing the antenna. At the same time, information concerning the instant elevation angle and the azimuth angle of the parabolic antenna is inputted to the control section, which in turn operates to store this signal in the memory section after processing.

The receiving section is a device for receiving and observing the carrier wave from the satellite aimed at. In the case of TV broadcasting through the satellite, the receiving section may be constituted by the cathode ray tube of a TV receiver. The receiving section, however, may be constituted by other means such as a current measuring device, for measuring the electric current in the tuning circuit.

The antenna mounting section incorporates the elevation driving unit and the azimuth driving units which were mentioned before. The elevation driving unit and the azimuth driving unit have rotation mechanisms carrying the parabolic antenna. In operation, the rotary mechanisms are driven to set the parabolic antenna in any desired direction, in accordance with the driving signals from the elevation and azimuth driving sections. The rotary mechanisms have shafts provided with pulse signal generators, which produce pulses corresponding to the amounts or angles of rotation of these shafts. The driving of the shafts is stopped when designated angles are reached by respective shafts.

Other objects, features and advantages of the invention will become clear from the following description of the preferred embodiment when the same is read in conjunction with the accompanying drawings.

BRIEF DESCRIPTION OF THE DRAWINGS

The attached sole FIGURE is a block diagram of an apparatus embodying the present invention for setting the direction of the parabolic antenna.

DESCRIPTION OF THE PREFERRED EMBODIMENT

A preferred embodiment of the invention will be described hereinunder with reference to the accompanying drawing for the purpose of illustration and not in the limiting sense.

The apparatus has a controlling section 1 which is connected to a setting section 2, selecting section 3, memory section 4, receiving section 5, elevation driving section 6, azimuth driving section 7, elevation angle setting rotary section (servo motor) 8 and an azimuth angle setting rotary section (servo motor) 9. The control section 1 is composed of various parts which include: a setting input/output circuit 10, select/receiving input/output circuit 11, main central processsing unit circuit 12 (referred to as "main CPU circuit", hereinunder), servo central processing unit circuit 13 (referred to as "servo CPU circuit", hereinunder), multi BUS control circuit 14, read only memory circuits 15, 16 (referred to as "ROM circuit", hereinunder), digital-to-analog signal conversion circuits 17, 21 (referred to as D/A conversion circuit), frequency-voltage signal conversion circuits 18, 22 (referred to as "F-V conversion circuit", hereinunder), forward-backward discriminating circuits 20, 24 and up/down counter circuits 19, 23.

It will be seen that the D/A conversion circuits 17, 21 F-V conversion circuits 18, 22 up/down counter circuits 19/23 and the forward-backward judging circuits 20, 24 are arranged in pairs, one for setting of the elevation angle, the other being for setting of the azimuth angle.

Between the control section 1 and the setting section 2, a setting input/output circuit is provided to serve as a gate circuit through which signals such as RS-232C signal is inputted and outputted, while a selecting-receiving input/output circuit 11 is provided between the selecting section 3 and the receiving section 5 to serve as a gate circuit for signals coming from the selecting section 3 and the receiving section 5. The setting input/output circuit 10, selecting-receiving input/output circuit 11 are connected to the main CPU circuit 12 so that signals from the setting section 2, selecting section 3 and the receiving section 5 are delivered to the main CPU circuit 12

In the described embodiment, the main CPU circuit 12 is constituted by an 8-bit microprocesor or like means, and functions to read the program from the ROM circuit 15 upon receipt of signals from the setting section 2 and the selecting section 3. The main CPU circuit 12 then delivers instruction signals to the circuits of the control section 1 in accordance with the programmed sequence, and processes the answer back signals from these circuits to produce information signals which are fed to the setting section 2 and the selecting section 3. The memory section 4 is connected to the CPU circuit 12 and delivers to the latter information concerning the elevation angles, azimuth angles and other data concerning the satellites.

The servo CPU circuit 13 is adapted for conducting the control of the elevation driving section 6 and the azimuth driving section 7. In the described embodiment, the servo CPU circuit is constituted by, for example, a 16-bit microprocessor, and is connected to the multi-BUS circuit 14, ROM circuit 16, D/A conversion circuits 17, 21 and up/down counter circuits 19 and 23, respectively. The arrangement is such that the information signals from the main CPU circuit 12 are delivered to the elevation driving section 6 and/or the azimuth driving section 7, so that the servo motors constituting the elevation angle setting rotary section 8 and the azimuth angle setting rotary section 9 are controlled by means of pulse signals delivered by the driving sections 6 and 7. More specifically, the sequence program is read out of the ROM circuit 16 in accordance with the instruction signals from the main CPU circuit 12, and operation instruction signals are delivered to the multi-BUS circuit 14 and the D/A conversion circuits 17, 21. At the same time, information concerning the elevation angle and the azimuth angle, delivered by the main CPU circuit 12, is read and sorted into two systems: namely, the elevation angle control system and azimuth angle control system, so that the information signals for the elevation angle and the azimuth angle are delivered to respective D/A conversion circuits 17 and 21.

The multi-BUS control circuit 14 is connected to the main CPU circuit 12 and the servo CPU circuit 13, so as to control the exchange of information between these two circuits, i.e., the delivery of the operation instruction signals, answer back signals and so on. In the described embodiment, a shift register and a FIFO are used to permit the reading and writing of signals from and into respective CPU circuits.

The ROM circuit 15 is connected to the BUS line of the main CPU circuit 12, while the ROM circuit is connected to the BUS line of the servo CPU circuit 13.

The ROM circuits 15 and 16 store programs which are essential for the operation of the apparatus of the invention.

The CPU circuits 12 and 13 are controlled in accordance with this program. An 8k-bit IC ROM is used as the ROM element.

The ROM circuit 15 stores a program which determines the timings of delivery of operation instruction signals from the main CPU circuit 12 to the setting section 2, selecting section 3, memory section 4, receiving section 5 and the servo CPU circuit 13, as well as the timings of the delivery of information signals from these sections to the main CPU circuit 12.

As explained before, there are two D/A conversion circuits 17 and 21. The D/A conversion circuit 17 is connected at its input side to the servo CPU circuit 13 and at its output side to the elevation driving section 6. Similarly, the D/A conversion circuit 21 is connected at its input side to the servo CPU circuit 13 and at its output side to the azimuth driving section 7. The signals for driving the servo motors in the elevation and azimuth angle setting rotary sections 8, 9 delivered by the servo CPU circuits are digital signals. These digital signals are converted into analog signals for driving the servo motors, by means of these D/A conversion circuits. Namely, these circuits 17 and 21 produce binary-coded analog signals corresponding to the digital signals. In the described embodiments, 12-bit D/A conversion IC elements are used as the D/A converter.

There are two F-V conversion circuits 18 and 22. The F-V conversion circuit 18 is connected at the input side to the forward-backward rotation judging circuit 20 for elevation angle system and at its cutput side to the elevation driving section 6. Similarly, the F-V conversion circuit 22 is connected at its input side to the forward-backward rotation circuit 24 and at its output side to the azimuth driving section 7. The servo motors of the elevation angle setting rotary section 8 and the azimuth angle setting rotary section 9 incorporate pulse generators which produce pulse signals of frequencies corresponding to the number of rotations of the servo motors. These pulse signals are converted by the F-V conversion circuits 18 and 22 into analog signals corresponding to the frequencies of these pulse signals.

There are two forward-backward rotation judging circuits 20 and 24. The forward-backward rotation judging circuit 20 is connected at its input side to the elevation angle setting rotary section 8 and at the output side thereof to the up-down counter circuit 19 and F-V conversion circuit 18 of the elevation angle system. Similarly, the forward-backward rotation judging circuit 24 is connected at its input side to an azimuth angle setting rotary section 9 and at its output side to the up-down counter circuit 23 and the F-V conversion circuit 24 of the azimuth angle system. The forward-backward rotation judging circuits 20 and 24 are the gate circuits, which discern the directions of rotation of the servo motors in the elevation and azimuth angle setting rotary sections 8, 9, by examining the pulses derived from the pulse generators incorporated in these servo motors. More specifically, the pulse generator of each servo motor produces a pulse signal consisting of two phases, A and B, so that the direction of rotation can be known by judging the time relation between these two phases. At the same time, the rotation speed of the servo motors can be known from the frequencies of these pulse signals, regardless of the direction of rotation.

There are two up-down counter circuits 19 and 23. The up-down counter 19 is connected at its input side to the forward-backward rotation judging circuit 20 of the elevation angle system and at its output side to the servo CPU circuit 13. Similarly, the up-down counter circuit 23 is connected at its input side to the forward-backward rotation judging circuit 24 and at its output side to the servo CPU circuit 13. The pulse signals representing the speed and direction of rotation of the servo motors are delivered by the forward-backward rotation judging circuits 20 and 24 to respective up-down counters 19 and 23. Upon receipt of these pulse signals, the counter circuits 19 and 23 perform up-counting operation or down-counting operation, thereby computing the amounts of rotation of the elevation and azimuth angle setting rotary sections from respective reference positions, e.g., points of origin or zero. These counter circuits 19 and 23 deliver the thus computed amounts of rotation to the servo CPU circuit 13 in the form of binary-coded signals.

The setting section 2 is connected to the control section 1 and is constituted by an input/output circuit 25, a setting central processing circuit 26 (referred to as "setting CPU circuit", hereinunder), key switch circuit 27 and a display circuit 28.

The input/output circuit 25 is connected to the setting input/output circuit 10 and the setting CPU circuit 26 of the control section 1. The RS-232C serial signal of TTL level outputted from the CPU circuit 26 is delivered, after a voltage conversion performed by the input/output circuit 25, to the control section 1. At the same time, the serial information signal trasmitted from the control section 1 by way of RS-232C is received by the setting CPU circuit 26, which then performs a voltage conversion of this signal into signals of TTL level.

The setting CPU circuit 26 is connected to the input-/output circuit 25, key switch circuit 27 and the display circuit 28. The setting CPU circuit 26 is adapted to produce, upon receipt of a switch information derived from the key switch circuit 27, a serial signal of TTL level which complies with the transmission format of the RS-232C, and to deliver this serial signal to the output circuit, while receiving the serial information signal which is transmitted from the control section 1 by way of the RS-232C transmission format and delivering this signal to the display circuit 28.

The key switch circuit 27 is connected at its output side to the CPU circuit 26 and delivers the information necessary for the operation of the apparatus in accordance with the invention. The key switch circuit 27 is constituted by a ten-key switch device having ten keys 0 to 9, a mode selecting switch device for selecting any desired mode, and switch devices for rotating the elevation and azimuth angle setting rotary sections 8, 9. Instructions are given to the setting CPU circuit as each switch is operated.

The display circuit 28, which is connected at its input side to the setting CPU circuit 26, is adapted to display the information concerning the elevation angles and azimuth angles of the satellites derived from the control section 1, as well as the information inputted through the key-switch circuit and processed by the setting CPU circuit 26. A liquid crystal display, plasma display or other known display can be used as the means of display.

The selecting section 3 is connected to a control section 1, and is provided with an input/output circuit 29, switch circuit 30 and a display circuit 31. The input-/output circuit 29 is connected to the select-receiving input/output circuit 11. The selecting section 3 constitutes a gate circuit through which the control section is connected to the selecting section 3. Thus, the selecting section 3 is operative to deliver the input information from the switch circuit 30 to the control section 1 and also to pass the watching signals for the desired satellite to the display circuit 31.

The switch circuit 30 is connected at its output side to the input/output circuit 29, and has switches corresponding to respective satellites. By depressing the switch corresponding to the desired satellite, a switch contact signal is delivered to the control section 1 through the input/output circuit 29.

The display circuit 30 is connected at its input side to the display circuit 31 so that it can display the satellite which is aimed at by the parabolic antenna 36.

As the desired satellite is selected by means of the switch circuit 30, the selection signal is delivered to the control section 1 through the input/output circuit 29. In consequence, the watching signal which indicates that the parabolic antenna is directed toward the selected satellite is derived from the control section 1 and is inputted to the display circuit through the input/output circuit 29 so as to be put on display.

Practically, the display is made by displaying a numeral corresponding to the selected satellite or by lighting one of the lamps or light-emitting diodes provided for respective satellites.

The memory section 4 is connected to the BUS line of the main CPU circuit 12 of the control section 1, and is composed of an interface circuit 32, memory circuit 33 and a battery circuit 34.

The interface circuit 32 is connected to the main CPU circuit 12 of the control section 1 by way of a BUS line type system and is connected also to the memory circuit. The interface circuit 32 controls the operation for writing information in the memory circuit 33, as well as the operation for reading the information from the memory circuit 33, in accordance with the instructions given by the main CPU circuit 12. Consequently, information signals are exchanged between the main CPU circuit 12 and the memory circuit 33 through this interface circuit 32.

The memory circuit 33 is an IC memory circuit connected to the interface circuit 32 and the battery circuit 34, and is capable of storing information such as the elevation angles and azimuth angles corresponding to the satellites, as well as other information which is necessary for the operation of the apparatus of the invention. This memory circuit 33 allows free writing and reading of the information. In the described embodiment, an 8k-bit IC RAM is used as the memory element.

The battery circuit 34 is connected at its output side to the memory circuit 33, and is intended for protecting the memory circuit so that the information stored in the memory circuit may not be extinguished even when the power supply to the apparatus in stopped accidentally or by the power switch being turned off. In the described embodiment of the invention, a nickel-cadmium battery is used as the battery.

The elevation driving section 6 and the azimuth driving section 7 are connected at their input sides to the control section 1 and at their output sides to the elevation and azimuth angle setting rotary sections, respectively. These driving units 6, 7 are operative to compare the feedback signals, i.e., the pulse signals from the pulse generators associated with the servo motors, with command voltages which are in this case the voltage signals derived from the D/A conversion circuits 17 and 21 of the control section 1, thereby effecting the speed control of respective servo motors, while amplifying the servo motor control signals obtained through the comparison between the command voltage and the feedback signals.

In the illustrated embodiment, each of the driving sections 6, 7 is constituted by a device which is generally referred to as a "servo-amplifier".

The elevation angle setting rotary section 8 is connected at its input side to the output side of the elevation driving section 6 and at its output side to the forward-backward rotation judging circuit 20. The elevation angle setting rotary section 8 is provided with a rotary shaft 37 which is connected to the parabolic antenna 36. The parabolic antenna is swung in the vertical direction by the operation of the servo motor of the elevation angle setting rotary section 8.

Similarly, the azimuth angle setting rotary section 9 is connected at its input side to the output side of the azimuth driving section 7 and at its output side to the forward-backward rotation judging circuit 2. The shaft of this section 9 is connected to a housing 40 which is provided in the mounting portion 39 of the parabolic antanna 36. The housing 40 accommodates the elevation angle setting rotary section 8. The arrangement is such that the housing 40 is rotated by the operation of the servo motor of the azimuth angle setting rotary section 9, to thereby rotate the parabolic antenna 36.

Each of the rotary sections 8 and 9 incorporates a transmission mechanism for changing the rotation of the servo motor to the vertical and horizontal swinging motion of the parabolic antenna.

The position of the parabolic antenna for each satellite is set in the manner explained hereinunder. First of all, the program mode switch (referred to as "PRG mode switch", hereinunder) of the key switch circuit in the setting section 2 is turned on. As a result, a PRG signal is read by the main CPU circuit 12 of the control section 1, so that the main CPU circuit 12 judges, by making reference to the program stored in the ROM circuit 15, that the present mode is the PRG mode. Consequently, the main CPU circuit 12 sends a signal representing that the present mode is the PRG mode, so that a display of the PRG mode is made by the display circuit 28 of the setting section 2. Subsequently, the user turns on an increment mode switch (referred to as "INC" mode switch, hereinunder) of the key switch circuit 27 in the setting section 2. In consequence, "SATELLITE No. 1" is displayed by the display circuit of the setting section 2, so that the apparatus becomes ready for adjustment of the elevation angle and azimuth angle to aim at the satellite No. 1.

Then, an elevation forward switch $E_1$, elevation backward switch $E_2$, azimuth forward switch $A_1$ and an azimuth backward switch $A_2$ of the key switch 27 in the setting section 2 are suitably operated to swing the parabolic antenna horizontally and vertically to attain the optimum state of signal derived from the receiving section 35.

For instance, as the azimuth forward switch $A_1$ is operated, a signal $A_1$ is delivered from the setting section 2 to the main CPU circuit 12 through the setting input/output circuit 10 in the control section 1. Subsequently, in accordance with the portion of the program read from the ROM circuit 15 of the main CPU circuit 12 corresponding to the signal $A_1$, the signal $A_1$ is read by the servo CPU circuit 13 through the multi-BUS control. As the signal $A_1$ is inputted to this servo CPU circuit 13, a digital signal is transmitted to the D/A conversion circuit 21 of the adimuth system, in accordance with the program sequence stored in the ROM circuit 16, and is changed into an analog command voltage through a voltage conversion. The analog command voltage is then transmitted to the azimuth driving unit 7 and is amplified to drive the servo motor of the azimuth angle setting rotary section 9 thereby to swing the parabolic antenna 36 rightward.

As the servo motor rotates, the pulse generator associated with the servo motor produces two phases of pulse signals A, B, the frequencies of which correspond to the rotation speed of the servo motor per unit of time. Upon receipt of these pulse signals, the forward-backward rotation judging circuit 24 operates to discern the direction of rotation, i.e., whether the servo motor is operating forwardly or backwardly, and produces a pulse signal which represents the direction of rotation. In the described case, since the azimuth forward operation is executed, the pulse signal produced by the forward-backward rotation judging circuit 24 represents that the servo motor is rotating forwardly. This pulse signal is then delivered to the F-V conversion circuit 22 and the up-down counter circuit 23. The forward pulse supplied to the F-V conversion circuit 22 is converted into an analog voltage corresponding to the rotation speed of the servo motor per unit of time. This analog signal is then delivered to the azimuth driving unit 7. The analog voltage supplied to the azimuth driving unit 7 is used for controlling the analog command voltage derived from the D/A conversion circuit 21 in such a manner that a constant rotation speed of the servo motor is obtained.

On the other hand, the forward pulse supplied to the up-down counter 23 causes this counter circuit 23 to conduct an up-counting operation. Consequently, the up-down counter circuit 23 produces an output which represents the rotational position of the azimuth angle setting rotary section 9, i.e., the azimuth angle of the parabolic antenna, in the form of a binary-coded signal.

The binary-coded signal from the up-down counter circuit 23 is read at a constant period by the program sequence of the ROM circuit 16 of the servo CPU circuit 13.

The above-described operation in conducted continuously until the switch $A_1$ in the key switch circuit 27 of the setting section 2 is turned off. Namely, the azimuth control operation is stopped when this switch $A_1$ is turned off.

Similar operation is conducted with other switches, i.e., the azimuth backward switch $A_2$, elevation forward switch $E_1$ and the elevation backward switch $E_2$, thereby to adjust the azimuth angle and the elevation angle of the parabolic antenna while watching the display on the receiving section 35. When the optimum state of receiving is attained, the set mode switch (referred to as "ST" switch) of the key switch circuit 27 of the setting section 2 is turned on, so that the main CPU circuit 12 of the control section 1 judges that the parabolic antenna is correctly aimed at the satellite No. 1, and delivers a signal indicating this state to the servo CPU circuit 13 through the multi-Bus control circuit 14, in accordance with the program sequence of the ROM circuit 15. As a result, the elevation and azimuth angles of the parabolic antenna, i.e., the binary-coded values delivered by the up-down counter circuits 19, 23, are read by the servo CPU circuit 13 and are stored in a predetermined area of the memory section 4, as the elevation and azimuth angles of the satellite No. 1.

This operation is conducted for each of the other satellites, so that the data concerning the elevation and azimuth angle of all satellites are stored in respective area of the memory section 4.

The data representing the elevation and azimuth angles of all satellites are thus stored in the memory section.

When the user wishes to select one of the satellites, he turns on the switch corresponding to that satellite, so that a signal is delivered to the main CPU circuit 12 through the select-receiving input/output circuit 11 of the control section 1, whereby the main CPU circuit 12 reads the information data concerning the elevation angle and the azimuth angle of the selected satellite from the aforementioned area of the memory section in accordance with the program sequence stored in the ROM circuit 15. The thus read out information data is sent to the servo CPU circuit 13 through the multi-BUS control circuit 14. The thus delivered information data includes a portion representing the elevation angle and a portion representing the azimuth angle. These portions are put into respective D/A converter circuits 17 and 21 and are changed into analog signals through a voltage conversion. The analog signals are then delivered to respective driving sections 6 and 7 to drive the servo motors of the elevation and azimuth angle setting rotary sections 8 and 9.

The two phases of pulse signals A, B from the pulse generators of respective servo motors are transmitted through corresponding forward-backward rotation judging circuits 20 and 24 to respective F-V conversion circuits and also the respective up-down counter circuits 19 and 23. The analog voltage from the F-V conversion circuits 18 and 22 control the analog command voltages coming from the D/D conversion circuits 17 and 21, thereby to attain constant rotation speeds of the servo motors. Meanwhile, the up-down counter circuits 19 and 23 produce binary-coded values of the elevation angle and azimuth angle, and send the same to the servo CPU circuit 13.

The servo CPU circuit 13 compares the binary-coded signals representing the azimuth and elevation angles of the selected satellite with the binary-coded values representing the elevation and azimuth angles as derived from the up-down counter circuits 19 and 23. When these signals have become equal, the digital information to be supplied to the D/A conversion circuit is reduced to zero, so that the elevation and azimuth driving sections stop in operation, thus in turn stopping the servo motors.

The servo CPU circuit 13 informs the main CPU circuit 12 of the fact that both information signals have become equal, i.e., the fact that the parabolic antenna 36 has been directed correctly to aim at the selected satellite, through the multi-BUS control circuit 14. In this state, the apparatus is ready for receiving the next satellite selecting instruction.

Effect of the Invention

As has been described, according to the invention, the longitude and latitude of the place where the antenna mounting portion is located, as well as the longitudes of a plurality of satellites are inputted through the setting section, while the control section computes the elevation angles and azimuth angles of the antenna with respect to the satellites, by making use of stored data such as the radius of the earth and the heights of the satellites, and stores these angle values in the memory section. According to the invention, therefore, it is possible to correctly direct the antenna toward the selected satellite through driving the elevation and azimuth angle setting rotary portions, simply by manipulating the switch corresponding to the designated satellite.

In general, broadcasting satellites are stationed above the equator, so that the longitudes thereof are constant. However, since the longitude and latitude of the antenna mounting portion vary depending on the case, it is quite difficult to correctly input the longitude and latitude through the setting section. Therefore, a user often fails to correctly direct the antenna towards the broadcasting satellite, due to errors inevitably involved in the setting of the elevation and/or azimuth angle.

This problem is completely overcome by the present invention because, in the present invention, the elevation angles and azimuth angles with respect to the satellites are minutely adjusted and the optimum data obtained through this adjustment are stored in the memory section. Thus, according to the invention, it is possible to easily direct the parabolic antenna to any one of a plurality of broadcasting satellites, by quite a simple and easy indoor operation.

From the foregoing description, it will be clear to those skilled in the art that the invention permits the user to quickly and correctly direct the parabolic antenna towards the desired satellite. Tbe invention, therefore, offers a great advantage over the prior art not only in the transmission and relaying of the waves to any from the satellites but also in the household receiving of TV signals from satellites.

Although the invention has been described through specific terms, it is to be noted here that the described embodiment is not exclusive and various changes and modifications may be imparted thereto without departing from the scope of the invention which is limited solely by the scope of the invention which is limited solely by the appended claims.

What is claimed is:

1. An apparatus for setting the direction of a parabolic antenna with respect to a broadcasting satellite comprising:

a parabolic antenna having an elevation driving section and an azimuth driving section to drive the parabolic antenna toward the broadcasting satellite;

a control section connected to the elevation driving section to control the elevation angle of the parabolic antenna and connected to the azimuth driving section of the antenna to control the azimuth angle of the parabolic antenna;

a memory section connected to the control section to be read out and to deliver the information concerning elevation angle, the azimuth angle and constants for the broadcasting satellite to the control section;

a setting section connected to the control section through an input/output circuit to input to the control section various information signals;

a selecting section connected to the control section through the input/output circuit to appoint and to select the desired satellite; and a receiving section connected to the control section through the input/output circuit to input information concerning the elevation angle and the azimuth angle of the parabolic antenna;

wherein said control section is adapted to receive the latitude and longitude of the point at which the antenna is situated, as well as the longitude of the satellite to be aimed at, and to calculate the elevation angle and the azimuth angle of the antenna for the desired satellite.

2. An apparatus in accordance with claim 1 wherein said memory section stores elevation angles and azimuth angles of various satellites as desired and constants necessary for the operation.

3. An apparatus in accordance with claim 2 wherein said constants necessary for the operation are the radius of the earth, and the altitude, the elevation angle and the azimuth of variuos satelites

4. An apparatus in accordance with claim 1 wherein said memory section is constituted by nonvolatile storage means.

5. An apparatus in accordance with claim 1 wherein said setting section is adapted to cause said memory section to store the elevation angle and azimuth angle of said parabolic antenna relative to a selected satellite when the state of receiving of TV carrier waves from said desired satellite is maximized.

* * * * *